US006959783B2

(12) United States Patent
Kwak et al.

(10) Patent No.: US 6,959,783 B2
(45) Date of Patent: Nov. 1, 2005

(54) FIGURE EIGHT DESCENDER

(76) Inventors: Hughes H. Kwak, 3994 S. 300 W. Suite 26, Salt Lake City, UT (US) 84107; Eugene Kwak, 3994 S. 300 W. Suite 26, Salt Lake City, UT (US) 84107

( * ) Notice: Subject to any disclaimer, the term of this patent is extended or adjusted under 35 U.S.C. 154(b) by 0 days.

(21) Appl. No.: 10/353,668

(22) Filed: Jan. 30, 2003

(65) Prior Publication Data

US 2004/0149516 A1 Aug. 5, 2004

(51) Int. Cl.[7] ..... A62B 1/00
(52) U.S. Cl. ..... 182/5; 182/193
(58) Field of Search ..... 182/5, 192, 193, 182/65.2–65.5

(56) References Cited

U.S. PATENT DOCUMENTS 316,870 A 4/1885 Braunfeld
1,114,392 A * 10/1914 Shuart ..... 182/193
1,149,394 A * 8/1915 Morrissey et al. ..... 188/65.3
4,678,059 A 7/1987 Bowkeer ..... 182/5
4,723,634 A * 2/1988 Fisk ..... 188/65.4
5,316,103 A * 5/1994 Bell et al. ..... 182/18
D376,095 S 12/1996 Curtis ..... D8/356
D458,533 S 6/2002 Sonju ..... D8/356

* cited by examiner

*Primary Examiner*—Alvin Chin-Shue
(74) *Attorney, Agent, or Firm*—Park & Sutton LLP; John K. Park

(57) ABSTRACT

A figure eight descender for rappelling with a rope includes a first loop, a second loop, a neck connecting the first loop and the second loop, and a clip attached on the neck. The clip surrounds the rope so that the clip contains the rope between the first loop and the second loop, preventing the rope from sliding over the first loop or the second loop. The clip has a U-shaped body, and the body has a first end and a second end. The first end is supported by a hinge provided on the neck so that the body can pivot around the hinge, and the clip is spring-biased so that the second end is forced toward the neck.

5 Claims, 8 Drawing Sheets

FIG. 1 [PRIOR ART]
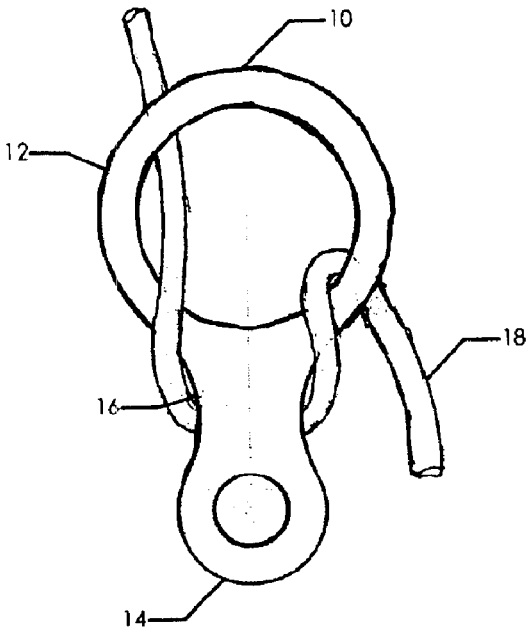
FIG. 2 [PRIOR ART]
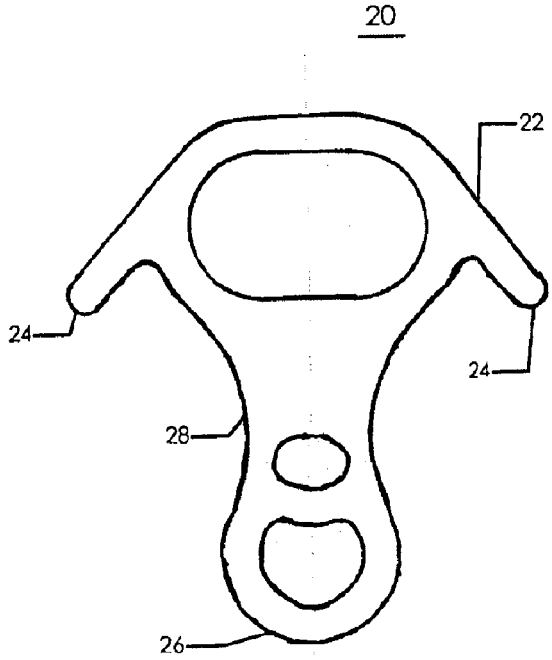

FIGURE EIGHT DESCENDER

BACKGROUND OF THE INVENTION

The present invention relates to a figure eight descender. More particularly, the invention relates to a figure eight descender that can prevent inadvertent slipping of a rope from the descender.

There are many implementations of a figure eight descender by prior art.

FIG. 1 shows a figure eight descender 10 by prior art. The figure eight descender 10 has a top ring 12 and a bottom ring 14 connected by a neck 16. A user makes a loop of in the middle of a rope 18, and pushes the loop through the top ring 12. Then the user pulls the loop over the bottom ring 14, and pulls the free end of the rope 18 so that the loop is tightly wound around the neck 16. The bottom ring 14 is for connection with a carabiner. The figure eight descender 10 holds the weight of a climber. One end of the rope 18 is connected to an anchor, while the other, free end of the rope 18 is grasped by the climber to control his or her rate of descent. The contours of the top ring 12 and the bottom ring 14 change smooth, and when the rope 18 is loose, there is a danger that the rope 18 might slip upward from the top ring 12 or downward from the bottom ring 14.

FIG. 2 shows another figure eight descender 20 that has a top ring 22 with two ears 24, a bottom ring 26, and a neck 28 connecting the top ring 22 and the bottom ring 26. While the ears 24 prevent slipping of a rope upward from the top ring 22 to some degree, it cannot prevent downward slipping of a rope.

U.S. Pat. No. 316,870 by Braunfeld discloses a fire-escape that is similar to the figure eight descender 20 but smaller.

U.S. Pat. No. 4,678,059 by Bowker discloses a rope descending device that includes an oval ring, a rail mounted on the ring, and a clasping means that spans the width of the ring. A rope passes the ring in a way different from that related to descenders 10, 20.

U.S. Pat. No. 4,723,634 by Fisk discloses a rappelling device that includes three integral eyes or rings. A rope is wound around the eyes in various combinations. A finger and a line guide, which are similar to the ear 24 of the descender 20, are provided and may be used to prevent upward slipping to some degree.

U.S. Pat. No. D-458,533 by Sonju discloses a tether coupler that is practically the same as the descender 10.

U.S. Pat. No. D-376,095 by Curtis discloses a rappelling device that includes one ring and four ears. The ears are used to hold a rope rather than to prevent slipping.

SUMMARY OF THE INVENTION

The present invention contrives to solve the disadvantages of prior art.

Therefore, an object of the invention is to provide a figure eight descender that prevents a rope from slipping to any direction.

Another object of the invention is to provide a figure eight descender that prevents a rope from slipping even when a rope is completely loose.

Still another object of the invention is to provide a figure eight descender that can make a climber's hands free while passing a rope through the descender.

Still another object of the invention is to provide a figure eight descender that prevents wrong rigging of a rope.

To achieve the above-described objects, the present invention provides a figure eight descender for rappelling with a rope. The figure eight descender includes a first loop, a second loop, a neck connecting the first loop and the second loop, and a clip attached on the neck. The clip surrounds the rope so that the clip contains the rope between the first loop and the second loop, preventing the rope from sliding over the first loop or the second loop. The first loop is circular, and the second loop has a shape of a rounded rectangle. The neck has a neck aperture.

The clip has a U-shaped body, and the body has a first end and a second end. The first end is supported by a hinge provided on the neck so that the body can pivot around the hinge, and the clip is spring-biased so that the second end is forced toward the neck.

The size of the first loop is bigger than the size of the second loop, and the hinge is provided adjacent the first loop.

The second end of the clip engages with a boss provided on the neck so that the clip may not be pivoted. The boss has a stem that is fixed to the neck, and a head that is connected to the stem. The size of the head is bigger than the size of the stem, so that the clip can be disengaged from the boss only when a force larger than a predetermined magnitude is applied.

Preferably, the boss is circular.

A projection protrudes from the neck inside the first loop. The projection has a semi-circular shape, and the hinge is provided on the projection.

In one aspect of the invention, the clip is made of wire. The U-shaped body includes two U-shaped wire portions, and the second end of the U-shaped body includes a semi-circular wire portion that connects the two U-shaped wire portions.

In another aspect of the invention, the clip has an engaging hole at the second end, and the engaging hole engages with the boss. The U-shaped body of the clip may have a clip aperture. The clip may be made of engineering plastic or of light metal.

In still another aspect of the invention, the clip has a hinge, a handle and a U-shaped body that connects the hinge and the handle. The hinge is received in a first recess provided in the neck so that the clip can pivot to and away from the neck. The clip is spring-biased so that the handle is forced toward the neck. The handle is received in a second recess provided in the neck, and engages with a spring-loaded projection so that the clip can be pivoted away from the neck only when a force larger than a predetermined magnitude is applied. The projection is received in a hole provided in the second recess. The clip may be made of wire, engineering plastic or light metal. The U-shaped body of the clip may have a clip loop so that the descender may be hung with a carabiner passing through the clip loop thereby freeing both hands of a user. Preferably, the clip loop is integrated with the handle of the clip.

The advantages of the present invention are numerous in that: (1) the figure eight descender completely prevents a rope from slipping away from the descender; (2) the figure eight descender prevents a user from rigging a rope around the descender in a wrong direction; (3) the figure eight descender frees both hands of the user during rigging a rope around the descender; and (4) the figure eight descender prevents dropping the descender inadvertently.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 1 is an elevation view of a figure eight descender by prior art;

FIG. 2 is an elevation view of another figure eight descender by prior art;

DETAILED DESCRIPTION OF THE PREFERRED EMBODIMENTS

Figure 3:
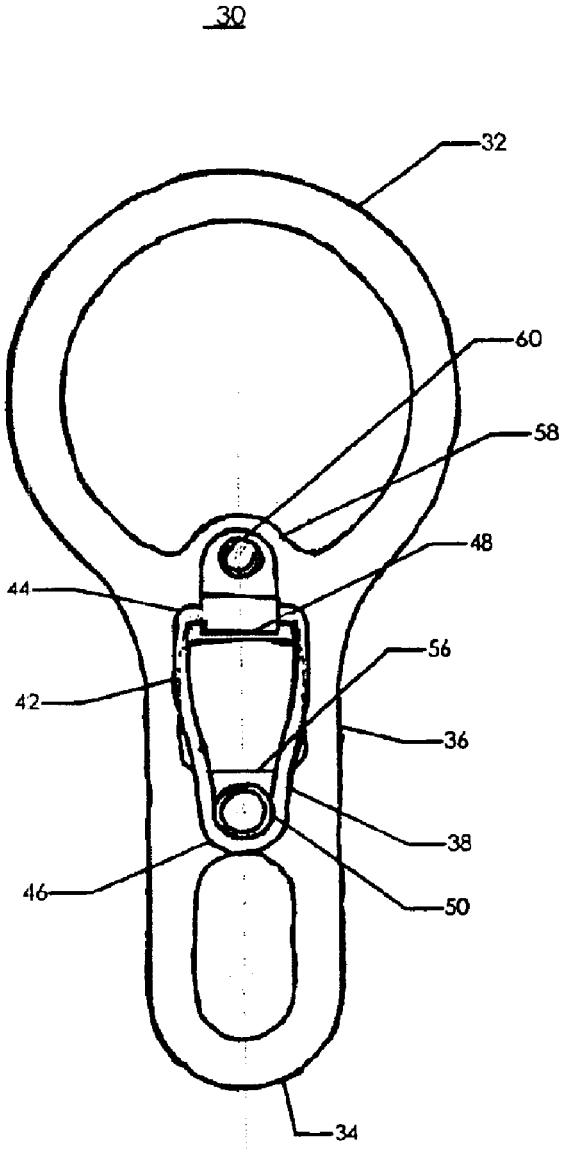
FIG. 3 is a front elevation view of a figure eight descender according to the first embodiment of the present invention.
Figure 4:
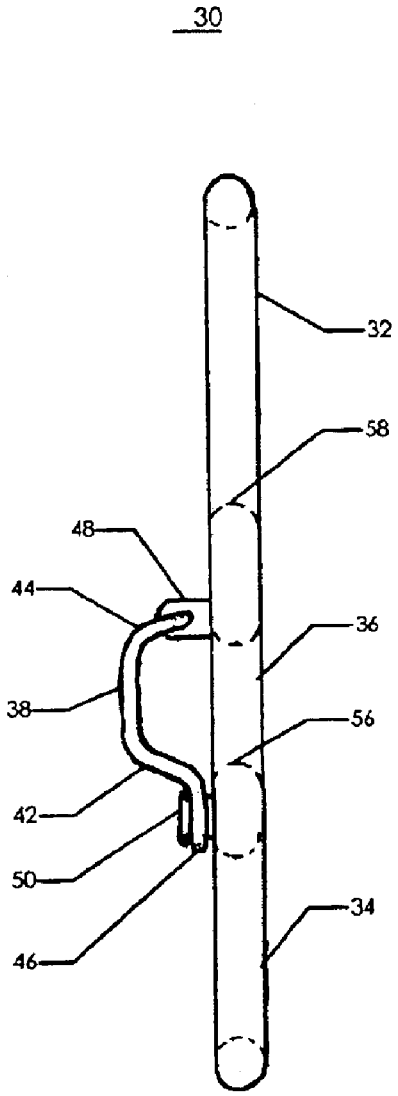
FIG. 4 is a side elevation view of the figure eight descender.

FIGS. 3 and 4 show a figure eight descender 30 for rappelling with a rope according to the first embodiment of the present invention. The figure eight descender 30 includes a first loop 32, a second loop 34, a neck 36 connecting the first loop 32 and the second loop 34, and a clip 38 attached on the neck 36.

Figure 5:
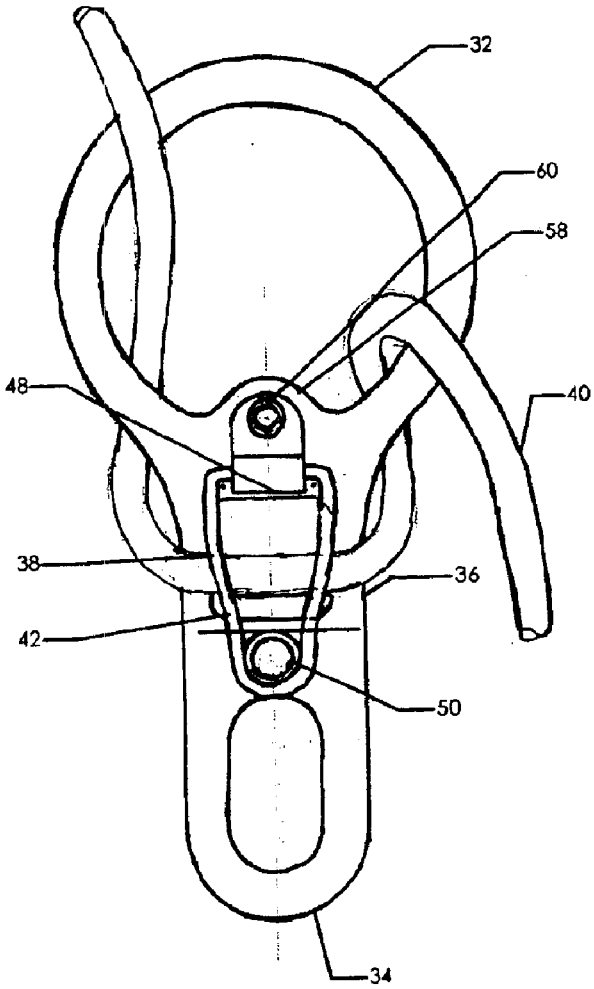
FIG. 5 is a front elevation view of the figure eight descender with a rope wound around it.
Figure 6:
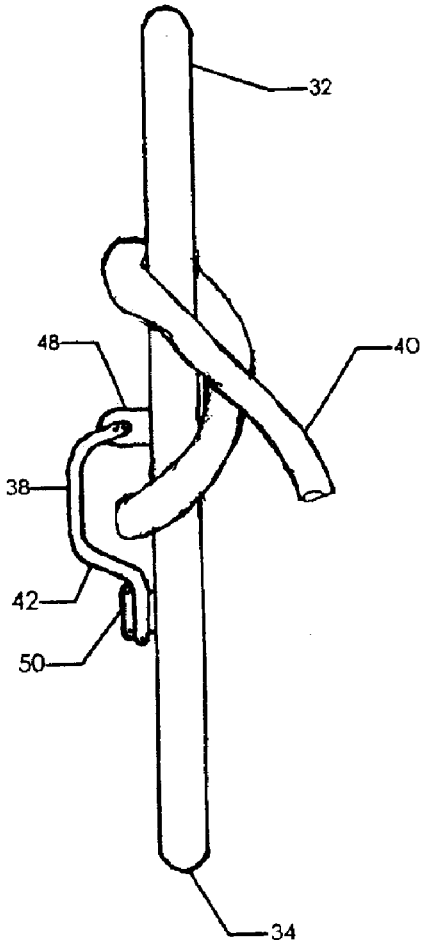
FIG. 6 is a side elevation view of the figure eight descender with a rope wound around it.

FIGS. 5 and 6 show that the clip 38 surrounds a rope 40 so that the clip 38 maintains the rope 40 between the first loop 32 and the second loop 34, preventing the rope 40 from sliding over the first loop 32 or the second loop 34.

FIGS. 5–8 show the clip 38. The clip 38 has a U-shaped body 42, and the U-shaped body 42 has a first end 44 and a second end 46. The first end 44 is supported by a hinge 48 provided on the neck 36 so that the U-shaped body 42 can pivot around the hinge 48. The clip 38 is spring-biased so that the second end 46 is forced toward the neck 36.

The size of the first loop 32 is bigger than the size of the second loop 34, and the hinge 48 is provided adjacent the first loop 32. A carabiner (not shown) attaches the second loop 34 to a harness (not shown) that a user is wearing. The rope 40 is wound around the first loop 32 and the neck 36 as shown in FIGS. 5 and 6. The first loop 32 is circular, and the second loop 34 has a shape of a rounded rectangle. The neck 36 has a shape of a bar connecting the first loop 32 and the second loop 34. The neck 36 has a neck aperture 56 to reduce weight of the figure eight descender 30.

Figure 11:
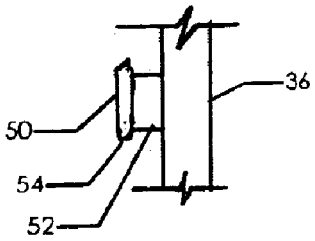
FIG. 11 is a side elevation view of a boss that engages with a clip.

The second end 46 engages with a boss 50 provided on the neck 36 so that the clip 38 may not be pivoted to be open. As shown in FIG. 11, the boss 50 has a stem 52 that is fixed to the neck 36, and a head 54 that is connected to the stem 52. The size of the head 54 is slightly bigger than the size of the stem 52. The clip is securely kept closed by this scheme. The clip 38 can be disengaged from the boss 50 against friction provided by the head 54 only when a force larger than a predetermined magnitude is applied on the clip 38 in the direction opening the clip 38. Preferably, the boss 50 is circular.

A projection 58 protrudes from the neck 36 inside the first loop 32. The projection 58 has a semi-circular shape, and the hinge 48 is provided on the projection 58. A screw 60 fixes the hinge 48 to the projection 58.

Figure 7:
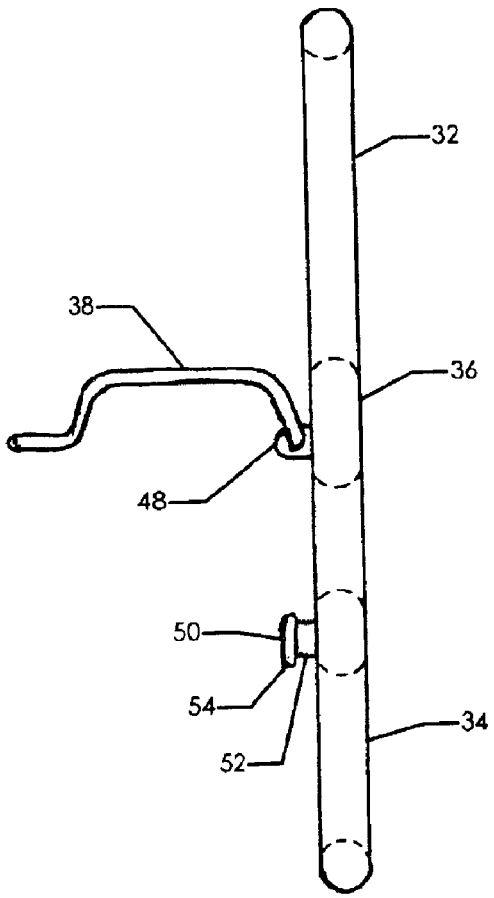
FIG. 7 is a view similar to FIG. 4 showing that a clip is pivoted away from the figure eight descender.
Figure 8:
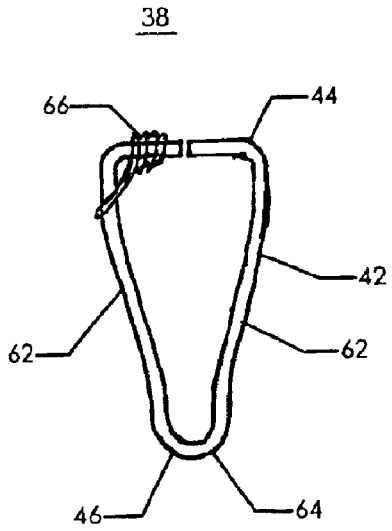
FIG. 8 is an elevation view of the clip and a spring.

FIG. 7 shows that the clip 38 is opened. FIG. 8 shows the clip 38. The clip 38 is made of wire. The U-shaped body 42 includes two U-shaped wire portions 62. The second end 46 of the U-shaped body 42 includes a semi-circular wire portion 64 that connects the two U-shaped wire portions 62. A spring 66 biases the clip 38 to be closed when the clip 38 is assembled.

Figure 9:
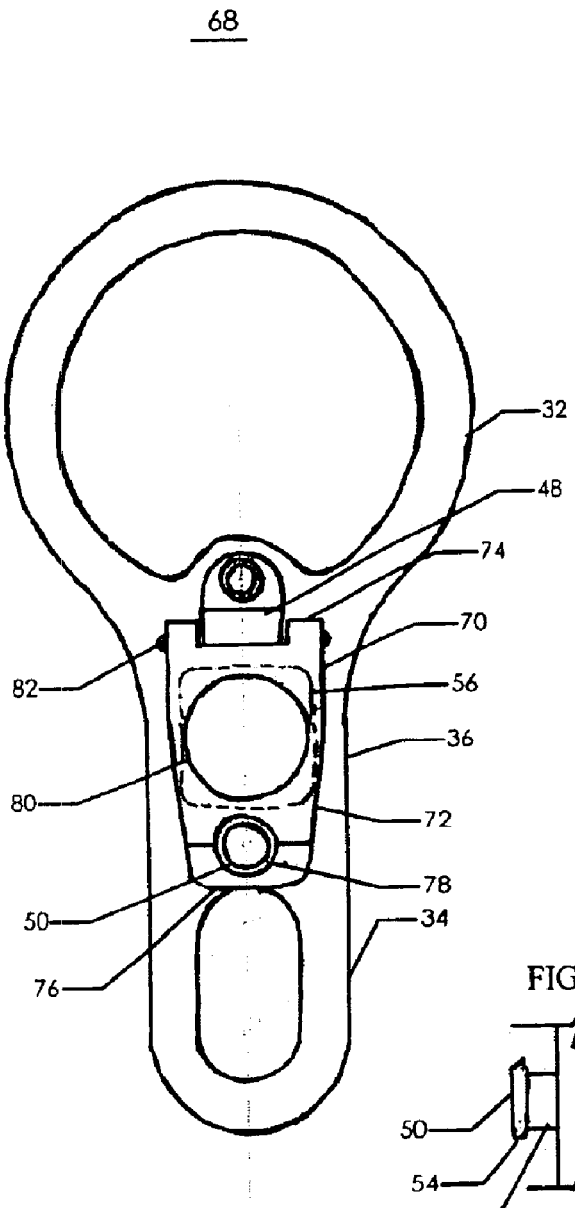
FIG. 9 is a front elevation view of a figure eight descender according to the second embodiment of the invention.
Figure 10:
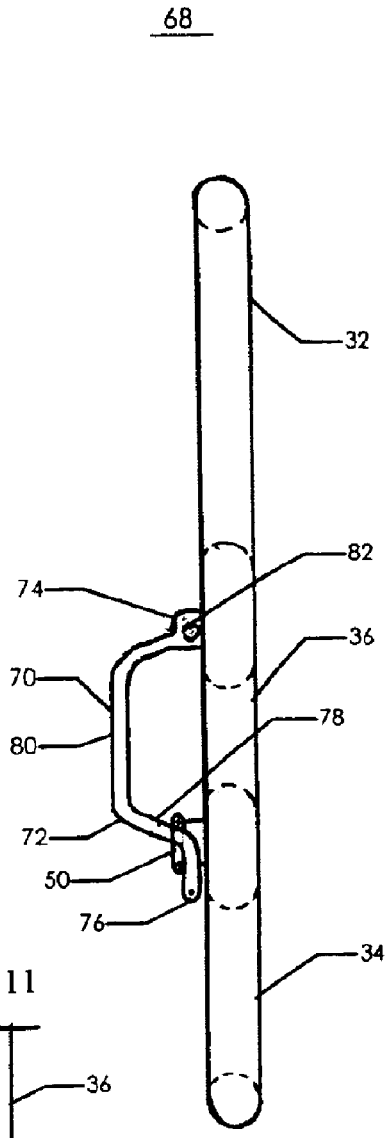
FIG. 10 is a side elevation view of the figure eight descender.

FIGS. 9 and 10 show a figure eight descender 68 according to the second embodiment of the invention. A clip 70 of the figure eight descender 68 has a U-shaped body 72. The U-shaped body 72 has a shape of a bent plate. The U-shaped body 72 has a first end 74 and a second end 76. The first end 74 is pivotally attached at the hinge 48 with a pin 82.

Figure 12:
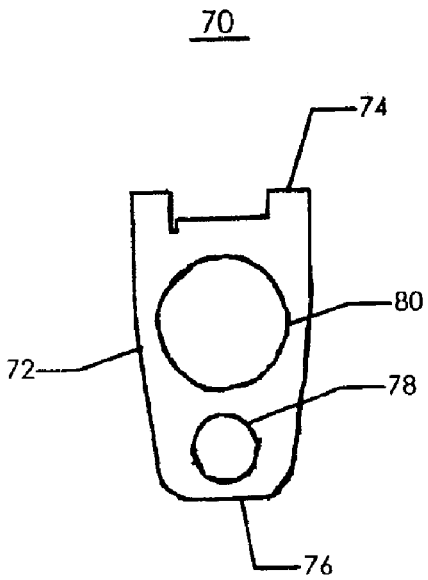
FIG. 12 is a front elevation view of a clip.
Figure 13:
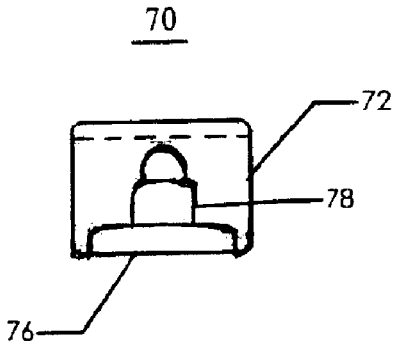
FIG. 13 is a bottom view of the clip.

FIGS. 12 and 13 show the clip 70. The clip 70 has an engaging hole 78 at the second end 76, and the engaging hole 78 engages with the boss 50. The U-shaped body 72 has a clip aperture 80 to reduce the weight of the clip 70. The clip 70 may be made of engineering plastic or light metal, such as extruded aluminum.

The U-shaped bodies 42, 72 of the clips 38, 70 have a dimension that allows enough space receiving the rope 40 between the clips 38, 70 and the neck 36, so that the rope 40 can move freely.

Figure 14:
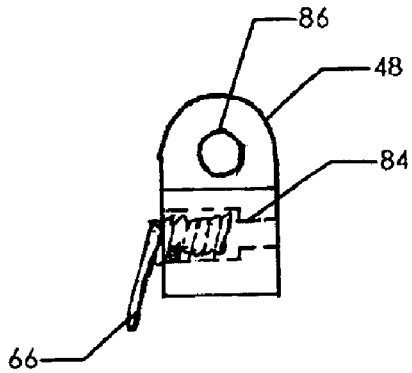
FIG. 14 is a front elevation view of a hinge and a spring.
Figure 15:
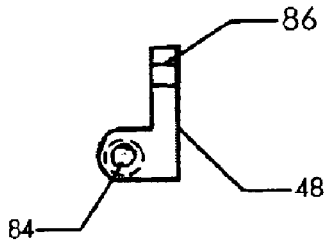
FIG. 15 is a side elevation view of the hinge.

FIGS. 14 and 15 show the hinge 48. The hinge 48 has a hinge hole 84 that receives the pin 82 and the spring 66, and a hole 86 that receives the screw 60 that fixes the hinge 48 to the projection 58.

Figure 16:
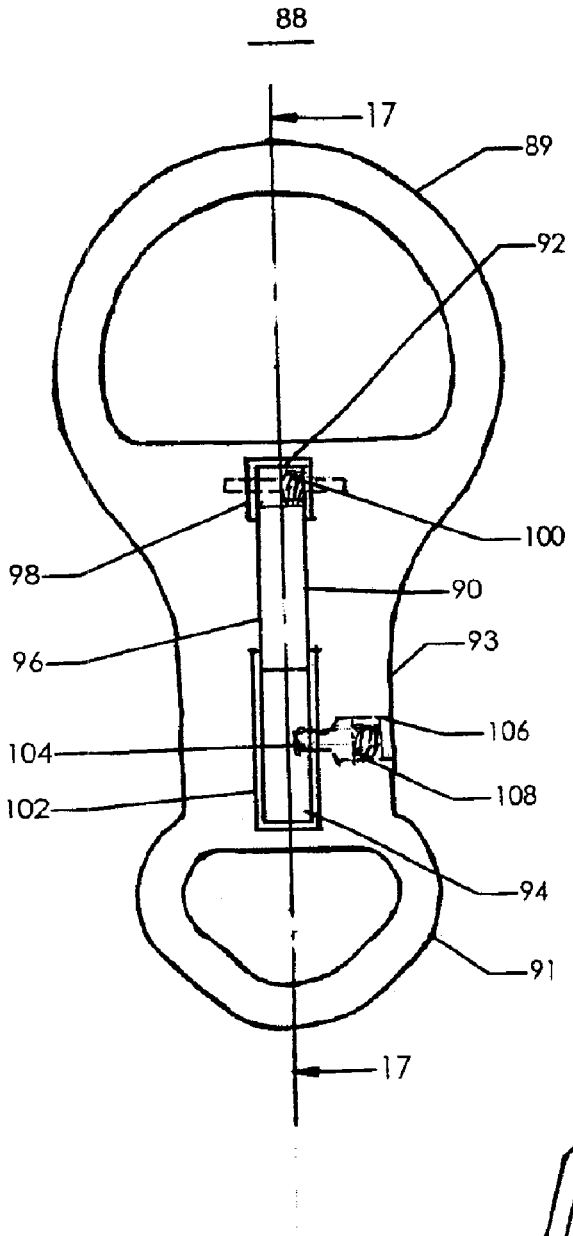
FIG. 16 is a front elevation view of a figure eight descender according to the third embodiment of the invention.
Figure 17:
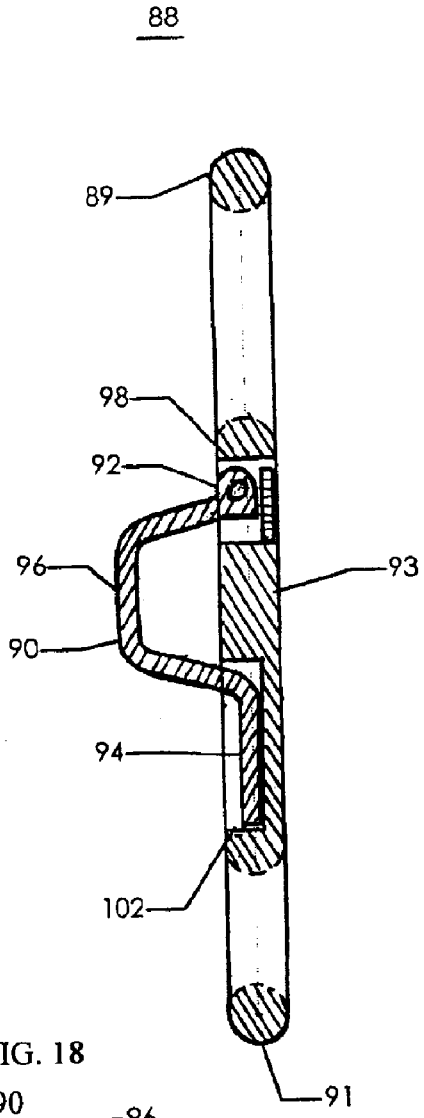
FIG. 17 is a cross-sectional view taken along the line 17—17 in FIG. 16.
Figure 18:
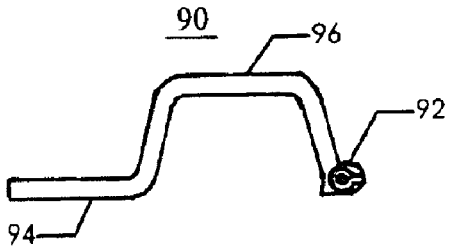
FIG. 18 is an elevation view of a clip.

FIGS. 16–18 show a figure eight descender 88 according to the third embodiment of the invention. The figure eight descender 88 has a first loop 89, a second loop 91, a neck 93 connecting the first loop 89 and the second loop 91, an a clip 90. The clip 90 has a hinge 92, a handle 94 and a U-shaped body 96 that connects the hinge 92 and the handle 94. The hinge 92 is received in a first recess 98 provided in the neck 93 so that the clip 90 can pivot to and away from the neck 93. The clip 90 is spring-biased by a spring 100 so that the handle 94 is forced toward the neck 93.

The handle 94 is received in a second recess 102 provided in the neck 93, and engages with a spring-loaded projection 104 so that the clip 90 can be pivoted away from the neck 93 only when a force larger than a predetermined magnitude is applied. The projection 104 is received in a hole 106 provided in the second recess 102, and is biased by a spring 108.

Figure 19:
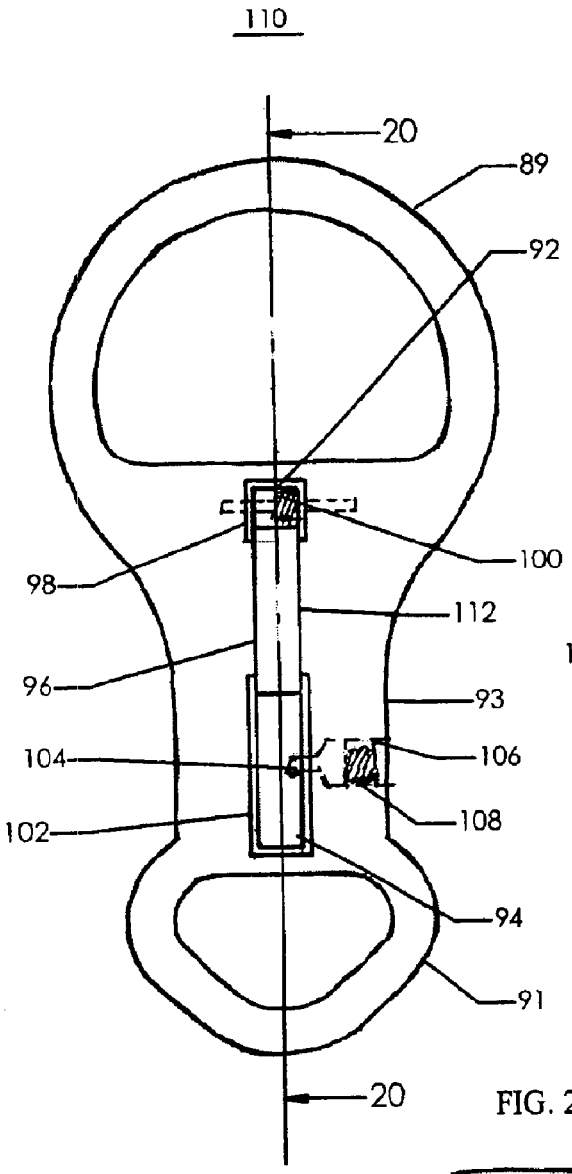
FIG. 19 is a front elevation view of a figure eight descender according to the fourth embodiment of the invention.
Figure 20:
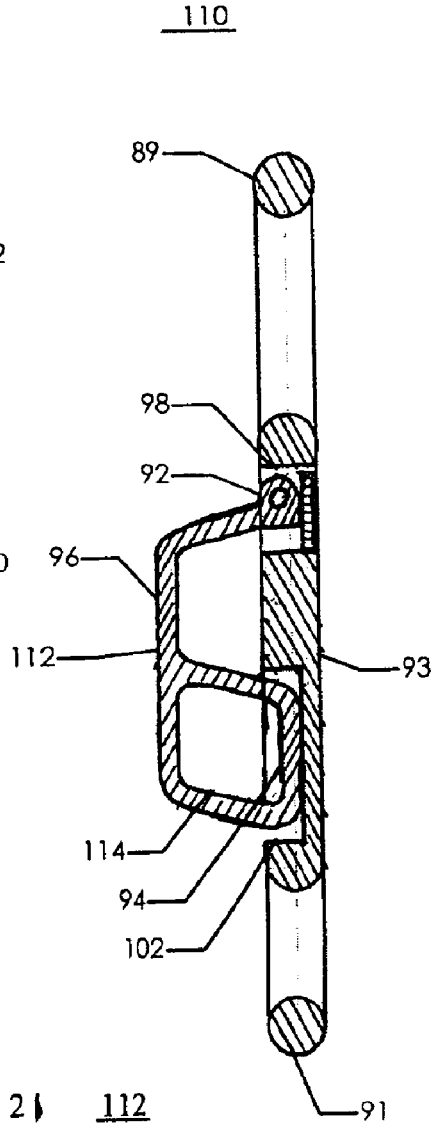
FIG. 20 is a cross-sectional view taken along the line 20—20 in FIG. 19.
Figure 21:
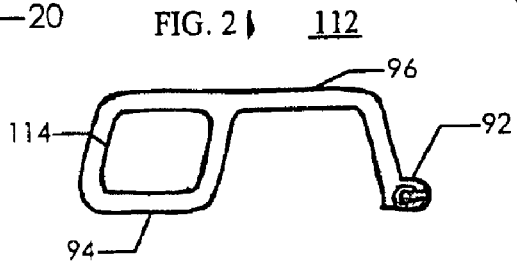
FIG. 21 is an elevation view of a clip.

FIGS. 19–21 show a figure eight descender 110 according to the foruth embodiment of the invention. The figure eight descender 110 is similar to the figure eight descender 88 but has a clip 112 that is different from the clip 90 in that a clip loop 114 is further provided. The clip loop 114 is integrated with the handle 94.

The clip 90, 112 may be made of wire, engineering plastic, or light metal.

How to use the figure eight descender 30, 68, 88, 110 for rappelling or adjusting descending speed is explained. First, the user separates the figure eight descender 30, 68, 88, 110 from the harness that he is wearing. Then the user may temporarily attach the figure eight descender to the harness by hooking the U-shaped body 42, 72, 96 of the clip 38, 70, 88 with a carabiner. The user can also hook the U-shaped wire portion 62 of the clip 38, the clip aperture 80 of the clip 70, or the clip loop 114 of the clip 112 with a carabiner for more secure holding of the figure eight descender 30, 68, 110. Since the figure eight descender is temporarily attached to the harness, the user can use her or his both hands freely. Then the user rigs the rope 40 as shown in FIGS. 5 and 6. In order to rig the rope 40 on the neck 36, 93, the user opens the clip 38, 70, 90, 112, passes the rope 40 under the clip 38, 70, 90, 112, and then closes the clip by engaging the second end 46, 76 of the clip 38, 70 with the boss 50, or engaging the handle 94 of the clip 90, 112 with the projection 104. After rigging the rope 40, the user attaches the figure eight descender 30, 68, 88, 110 to the harness by hooking the second loop 34, 91 with a carabiner. Then the user unhooks the carabiner that has hooked the clip 38, 70, 90, 112. The user is now ready to descend and can control the descending speed by grasping the rope 40.

With the above construction, the figure eight descender completely prevents a rope from slipping away from the descender to any direction. While the ears of the prior art figure eight descender shown in FIG. 2 prevents upward slipping of a rope to some degree, it cannot prevent downward slipping away of a rope, and if a rope is loose enough, the rope can bypass the ears. The clip in its closed state, completely encloses the rope, and thus the rope cannot slip away in any situations unless the clip is opened.

Since a rope should pass under the clip, the figure eight descender prevents a user from rigging a rope around the descender in a wrong direction.

Since the clip can also be used for holding the figure eight descender with a carabiner attached to a harness, the figure eight descender frees both hands of the during rigging a rope around the descender and also prevents dropping the descender inadvertently during rigging a rope.

Although the invention has been described in considerable detail, other versions are possible by converting the aforementioned construction. Therefore, the scope of the invention shall not be limited by the specification specified above.

What is claimed is:

1. A figure eight descender for rappelling with a rope comprising:

a) a first loop;

b) a second loop;

c) a neck connecting the first loop and the second loop; and d) a clip attached on the neck;

wherein the clip is adapted to contain the rope so that the clip contains the rope between the first loop and the second loop, preventing the rope from sliding over the first loop or the second loop, wherein the clip has a hinge, a handle and a U-shaped body that connects the hinge and the handle, wherein the hinge is received in a first recess provided in the neck so that the clip can pivot to and away from the neck, wherein the clip is spring-biased so that the handle is forced toward the neck, wherein the handle is received in a second recess provided in the neck, and engages with a spring-loaded projection whereby the clip can be pivoted away from the neck only when a force larger than a predetermined magnitude is applied.

2. The figure eight descender of claim 1, wherein the projection is received in a hole provided in the second recess.

3. The figure eight descender of claim 1, wherein the U-shaped body has a clip loop.

4. The figure eight descender of claim 1, wherein the clip loop is integrated with the handle.

5. The figure eight descender of claim 1, wherein the clip is made of wire.

* * * * *